US006055319A

United States Patent [19]

Shennib et al.

[11] Patent Number: 6,055,319

[45] Date of Patent: Apr. 25, 2000

[54] SELECTABLE HANDLE FOR HEARING DEVICES

[75] Inventors: Adnan Shennib, Fremont; Dennis A. Oberlander, San Leandro, both of Calif.

[73] Assignee: Decibel Instruments, Inc., Fremont, Calif.

[21] Appl. No.: 08/965,319

[22] Filed: Nov. 6, 1997

[51] Int. Cl.[7] ..... H04R 25/00

[52] U.S. Cl. ..... 381/328; 379/52; 381/312; 381/313; 381/329

[58] Field of Search ..... 381/314, 320, 381/322, 324, 326, 328, 329, 313, 133, 130, 312, 315, 380; 379/52

[56] References Cited

U.S. PATENT DOCUMENTS

| | | | |
|---|---|---|---|
| 4,565,904 | 1/1986 | Harada | 179/107 |
| 4,584,437 | 4/1986 | Giannetti | 179/107 |
| 4,756,312 | 7/1988 | Epley | 128/420.5 |
| 5,003,608 | 3/1991 | Carlson | 381/322 |
| 5,295,191 | 3/1994 | Van Vroenhoven | 381/68.6 |
| 5,381,484 | 1/1995 | Claes et al. | 381/68.6 |
| 5,395,168 | 3/1995 | Leenen | 381/68.6 |
| 5,604,812 | 2/1997 | Meyer | 381/314 |
| 5,717,771 | 2/1998 | Sauer et al. | 381/322 |
| 5,828,757 | 10/1998 | Michalsen et al. | 381/68.6 |

OTHER PUBLICATIONS

Shennib et al., Patent Application Entitled "Articulated Hearing Device", U.S. Serial No. 08/365,913, filed Dec. 29, 1994.

Fletcher et al., Patent Application Entitled "Articulation Assembly for Intracanal Hearing Devices", U.S. Serial No. 08/922,928, filed Sep. 3, 1997.

Chasin, "CIC Handbook," Singular Publishing Group, Inc., 1997 p. 180.

*Primary Examiner*—Paul Loomis
*Assistant Examiner*—Dionne N. Harvey
*Attorney, Agent, or Firm*—Michael A. Glenn

[57] ABSTRACT

The invention provides a replaceable handle for hearing devices that are deeply inserted into the ear canal. The handle is offered in an assortment of configurations to optimize the hearing devices cosmetic appeal and usability. The handle consists of a shaft, handle head and a locking end for insertion into the lateral end of a hearing device. The locking mechanism of a preferred embodiment consists of two inwardly flexible legs that compress while being inserted sideways into a locking receptacle within the lateral end of the hearing device. The legs spring back when they have been fully inserted, thus locking the handle to the hearing device. The handle remains securely attached to the device during normal use, which primarily subjects the device to axial or push/pull forces. However, the handle can be readily removed by opening the battery door and sliding the handle sideways into the cavity of the battery compartment.

19 Claims, 8 Drawing Sheets

SELECTABLE HANDLE FOR HEARING DEVICES

BACKGROUND OF THE INVENTION

1. Technical Field

The invention relates to hearing devices for communications and hearing aid applications. More particularly, the invention relates to hearing devices that are deeply inserted into the ear canal.

2. Description of the Prior Art

Technological advancements continue to reduce the size of hearing devices. This miniaturization is highly desirable for several reasons, including improved acoustics and cosmetic appeal. In hearing aids, for example, canal hearing devices that fit deeply into the ear canal are becoming increasingly popular. Canal devices are referred to as In-The-Canal (ITC) or Completely-In-the-Canal (CIC) depending on the depth of insertion. Alternatively, a hearing device may be an earpiece for audio and communications applications. Such hearing devices have also become considerably smaller and are being inserted more deeply into the ear canal.

Miniaturization of hearing devices presents substantial challenges to designers and users alike. Canal device designs must use the minimal available space to place components such as amplifiers, receivers (speakers), microphones, battery, controls, and wires with great efficiency. A design must also permit insertion and removal by the user with ease and accuracy. In view of the fact that the contours of the ear canal are narrow and bent (s-shaped), in sharp contrast to the simplified illustrations common in the literature, it is clear that inserting a device into the ear canal is quite challenging.

Handling and manipulating a hearing device during insertion or removal is especially problematic for those users who have limited dexterity. Hearing aid users, in general, tend to be elders who are likely to suffer from arthritis or neurological disorders affecting their motor function. These disorders, manifested by tremor, rigidity and irregular hand movements, make it difficult for many users to insert and remove a hearing aid properly. Improper insertion due to dexterity limitations not only leads to discomfort and cosmetic disadvantage, it also results in functional problems such as feedback. This phenomenon is manifested by an annoying whistling that occurs when acoustic leakages between a speaker and microphone are present. Therefore, feedback is likely to occur when a hearing device is not properly inserted into the ear canal.

Problems associated with insertion and removal of miniature hearing devices generally increase with the age of the individual wearer and also with increased miniaturization of the hearing device.

In the hearing aid industry, miniature canal devices are generally provided with a handle in the form of a strand that may be grasped with the fingertips to remove the device from the ear canal. The strand is typically attached permanently to the faceplate (the lateral end) of a hearing device. See, for example, Chasin, CIC Handbook, Chap. 10, pp. 180, Singular Publishing Group, Inc. (1997). The length, shape and texture of the strand handle is typically designed to minimize visibility to others while allowing maximum access and ease of handling by the user. To minimize the size of the hearing device, the strand handle is simply glued permanently to the hearing device during the manufacturing process.

Unfortunately, the features of a strand handle often require individual adjustments which cannot be anticipated prior to the custom fabrication process or the fitting. For example, a longer strand may be easier to handle for someone with dexterity limitations. However, a longer strand may be problematic for another due to anatomical interference from the pinna of the ear. Determining the correct physical features of the removal strand prior to the fitting process is not practical for many users in view of often conflicting requirements such as cosmetic appeal, usability, and the user's manual dexterity.

Because the handle is permanently attached, any modification or repair of a handle often requires returning the hearing aid to the manufacturer for retrofitting. This remake step not only delays the fitting process but also incurs additional expense for both the dispensing professional and the manufacturer, who typically offer liberal warranty policies to the end user.

Handle determination is further complicated by the fact that, post-fitting, a user may have different requirements after a learning process which may take several weeks. This may necessitate a subsequent retrofitting of a device which initially seemed well-suited for the user.

P. Van Vroenhoven, Hearing Aid Intended for Being Mounted Within the Ear Canal, U.S. Pat. No. 5,295,191 (Mar. 15, 1994) discloses a hearing aid with a dual function handle (extraction means 12) for extracting the hearing device and for conduction of infrared radiation into the hearing device. Similarly, J. Leenen, In the Ear Hearing Aid Having Extraction Tube Which Reduces Acoustic Feedback, U.S. Pat. No. 5,395,168 (Mar. 7, 1995) discloses a dual function handle for extracting a hearing device and for acoustically coupling sound into the hearing aid. A serious shortcoming of these devices is that the extraction element is fixed or fastened to the face-plate, thereby preventing the dispensing professional from selecting alternative handles which optimize ease of insertion and removal and cosmetic factors according to individual needs and preferences.

V. Giannetti, Hearing Aids of the Type Intended to be Fitted in the External Auditory Meatus of the User, U.S. Pat. No. 4,584,437 (Apr. 22, 1986) discloses a hearing device having a hinged battery cover such that the cover can be easily gripped by the user's fingers so that it can aid in positioning the aid in the user's ear. After insertion into the ear canal, the cover is then closed (FIG. 3, closed position), presumably for cosmetic reasons, during wearing. A major disadvantage of Giannetti is that considerable dexterity is required to lift the cover to the open position (FIG. 4) prior to removal of the miniature hearing aid from the ear.

M. Harada, Removal Handle for the Ear Hearing Aids, U.S. Pat. No. 4,565,904 (Jan. 21, 1986) also discloses a hinged handle with an enlarged end (bulbous end 30) for grasping with the fingers. One disadvantage of this device is that when the handle is in the closed position it is essentially flush with the face-plate making it difficult for persons with dexterity problems to open (FIG. 3) prior to grasping it to remove the deeply inserted hearing aid.

J. Carlson, Apparatus and Method for Manipulating Devices in Orifices, U.S. Pat. No. 5,003,608 (Mar. 26, 1991) discloses an apparatus and method for insertion and removal of a hearing device from the ear by using a similarly hinged handle which can swing out in response to a magnet placed near the handle, making it easy to grasp. One disadvantage of such an apparatus is that an external tool, a magnet, is required to pull the handle prior to grasping it. This is a serious inconvenience for users, particularly elders, who must remember to carry a magnet to insert and remove the hearing aid.

R. Claes and P. Van Vroenhoven, Hearing Aid With Pull-Out-String, Pull-Out String, and Method of Making a Hearing Aid, U.S. Pat. No. 5,381,484 (Jan. 10, 1995) disclose a removal strand with a plurality of beads at certain distances with respect to one another. Each bead can be severed to adjust the length of the strand according to the needs of the user. Claes et al. provide an advantage in terms of length adjustment. However, to select any other features such as grip size, texture or orientation requires the return of the hearing device to the manufacturer to replace the strand with a more suitable one.

It would be advantageous to provide a field selectable handle for hearing devices which meets the needs of the individual wearing the device. It would also be advantageous to provide a handle that is readily replaceable by the dispensing professional or by the user without requiring special tools, adhesives, or any labor intensive custom fabrication.

SUMMARY OF THE INVENTION

The invention provides a replaceable handle for miniature hearing devices that are deeply inserted into the ear canal. The handle is offered in an assortment representing various shapes to optimize cosmetic appeal and usability according to the needs and preferences of the individual user. The handle consists of a shaft, a handle head, and a locking end for insertion into the lateral end of a hearing device. The locking mechanism of the preferred embodiment of the invention consists of two inwardly flexible legs that compress while being inserted sideways into a locking receptacle within the hearing device. The legs spring back after they are fully inserted, thus locking the handle to the lateral end of the hearing device. The handle remains securely attached to the device during normal use, which primarily exerts axial or push/pull forces. However, the handle can be readily removed by opening the battery compartment of the hearing device and sliding the handle sideways through the cavity of the battery compartment.

The assorted handle is provided in various shapes, lengths, rigidity, and orientation to optimize the usability of the device according to the individual user. The handle head is also offered in various shapes and textures. For persons of minimal dexterity, a relatively rigid and long shaft oriented outward, may be recommended by the dispensing professional to provide the easiest grasp for the user. For persons of excellent dexterity, the dispensing professional might recommend a shorter, more flexible handle, oriented inward to facilitate removal while remaining inconspicuous, thus providing maximum cosmetic appeal.

DETAILED DESCRIPTION OF THE INVENTION

The invention described herein is a selectable handle for use with hearing devices that are deeply inserted into the ear canal. The handle is readily provided in various shapes, lengths, rigidity, and orientation to optimize the usability of the hearing device according to the needs and preferences of an individual wearer. The handle is designed to fit securely into the lateral surface of a hearing device equipped with the appropriate receptacle as described below.

The hearing device may be a hearing aid for the hearing impaired or an audio device for communicating audible signals into the ear canal of an individual. The invention is particularly suited for articulated hearing devices and earpieces as disclosed by Shennib, et al. in U.S. patent application Ser. No. 08/365,913 and Fletcher et al. in U.S. patent application Ser. No. 08/922,928. Briefly described, a receiver module or an earpiece, placed deeply into the ear canal proximal to the tympanic membrane, is articulated with respect to a main module which is positioned relatively further from the tympanic membrane than the receiver module or earpiece.

Figure 1:
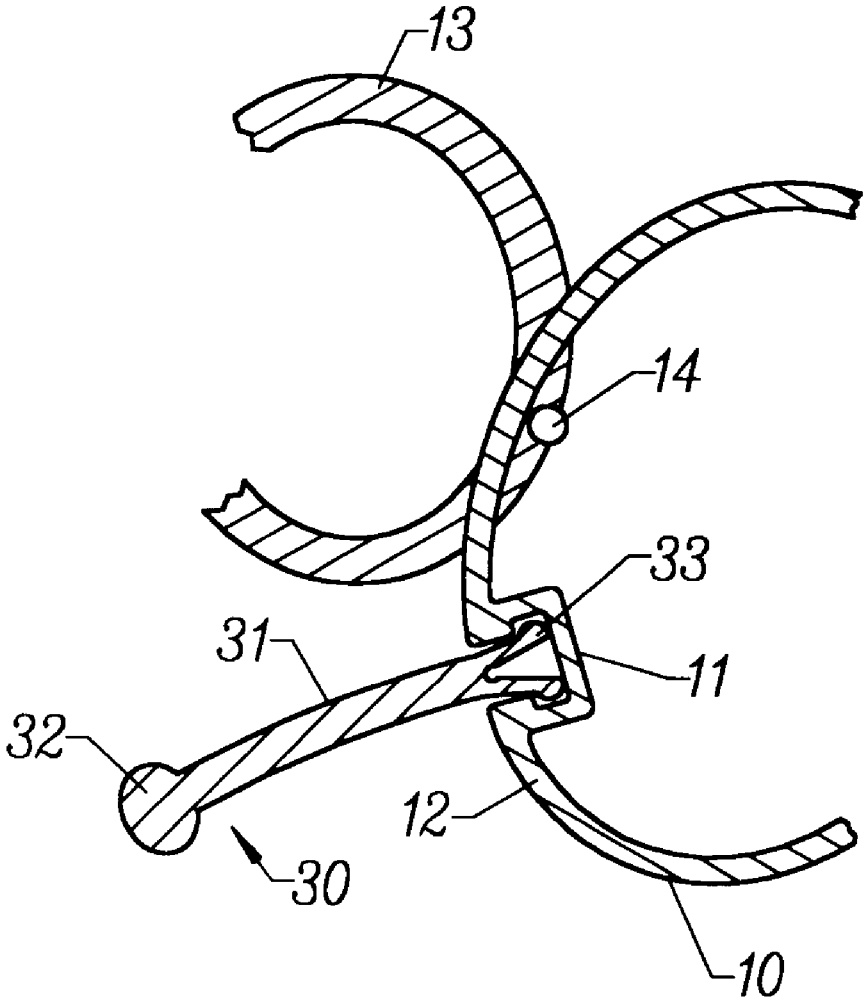
FIG. 1 shows a cross section of the handle and lateral end of a hearing device according to the invention.

The handle 30 as shown in FIG. 1 consists of a shaft 31 connecting a shaft head 32 to a handle locking end 33 which is inserted into a locking receptacle 11 that is formed within the lateral surface 12 of a hearing device 10.

Figure 2:
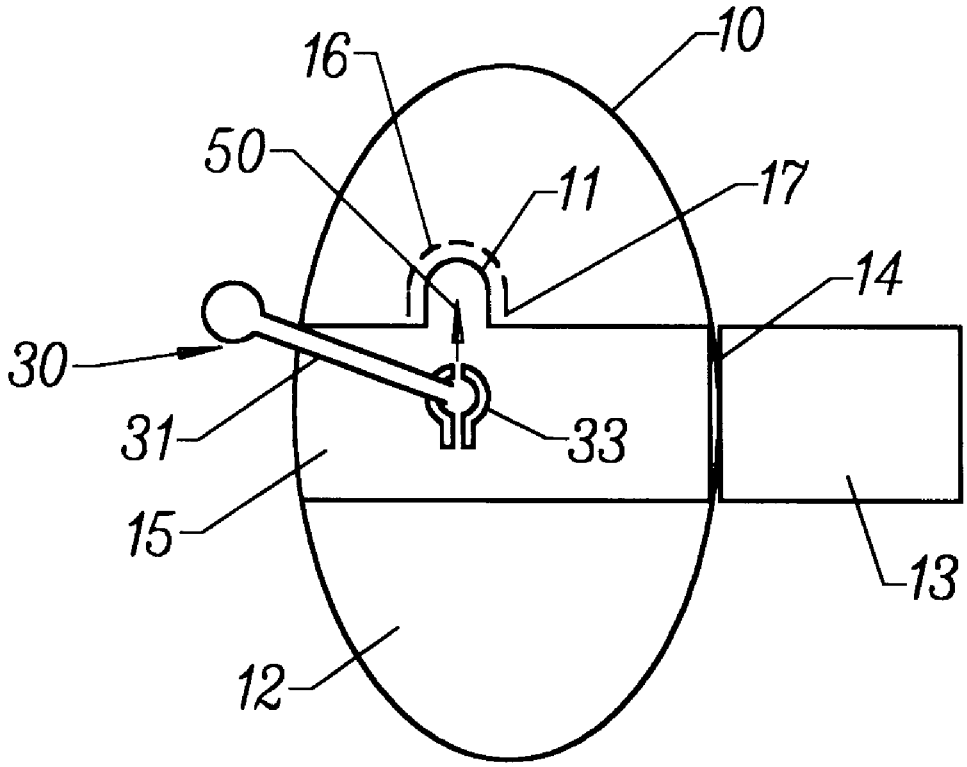
FIG. 2 shows a surface view of a hearing device lateral end showing handle insertion into the locking receptacle according to the invention.

FIG. 2 is a surface view of the lateral end 12 which shows handle 30 being inserted into the locking receptacle 11 in the direction shown by the arrow 50. The hearing device battery cavity 15, which is exposed by opening the battery compartment closure 13, provides sideways access to the locking receptacle 11. The battery closure 13 is pivotable on a hinge 14.

Figure 3:
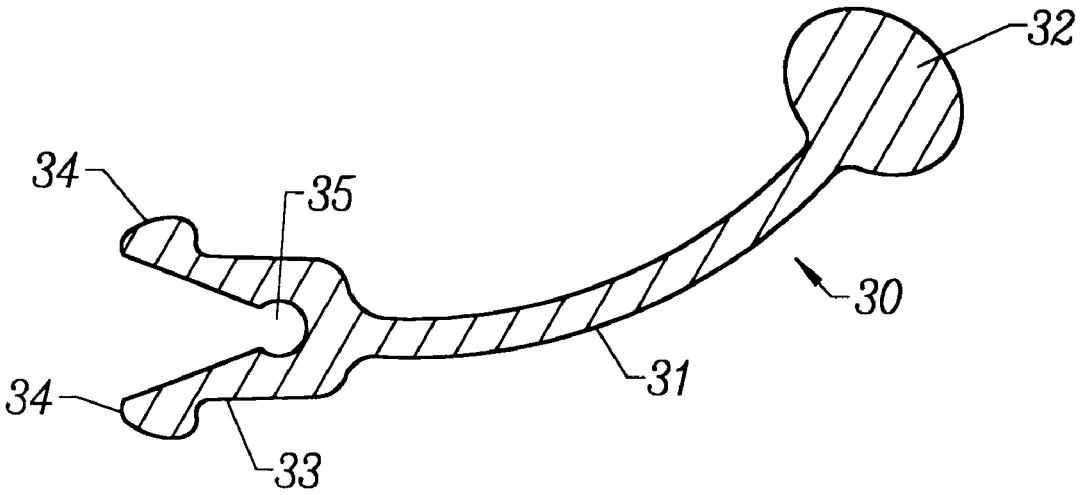
FIG. 3 shows a side view of the handle and its major segments according to the invention.

In a more detailed view of the handle, shown in FIG. 3, locking legs 34 of the handle locking end 33 compress while being inserted into the locking receptacle 11 (FIG. 2). A relieved area 35 facilitates compression of the locking legs while being inserted into the locking receptacle 11. A receptacle recess 16 and a locking ledge 17, just beneath the surface of the lateral end 12, secure the handle locking end 33 when it is fully inserted and its legs 34 have sprung back to the uncompressed position.

A key feature of the handle receptacle is that it is highly space-efficient, thus minimizing its impact on the overall size of the hearing device. Placement and removal of the handle do not require any adhesives or special tools and thus can be readily performed by the dispensing professional or the user.

Figure 4:
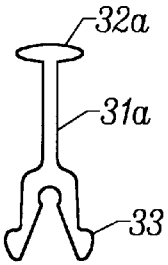
FIGS. 4–7 show various options for the selectable handle according to the invention.
Figure 5:
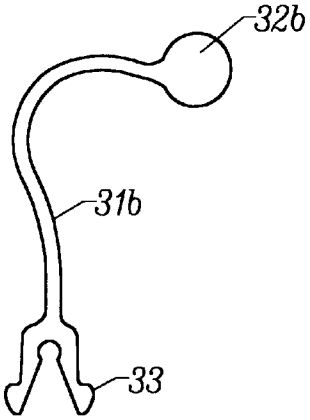
Figure 6:
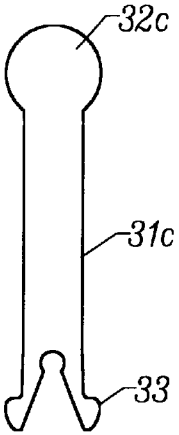
Figure 7:
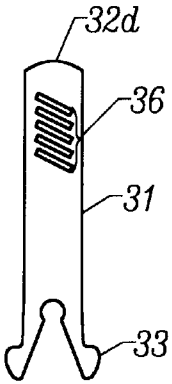

FIGS. 4–6 show various adaptations of the handle, which are intended to meet the diverse needs of individuals wearing miniature hearing devices. FIG. 4 shows a handle having a relatively short shaft 31*a* and a relatively flat head 32*a* for persons of good dexterity who require little assistance with inserting or removing the hearing device. FIG. 5 shows a handle with a relatively longer shaft 31*b* and with spherical head 32*b* for persons who have moderate dexterity. FIG. 6 shows a handle having a rigid shaft 31*c* and large head 32*c* for persons who have poor dexterity and who must therefore rely substantially on the handle for insertion and removal of the hearing device. FIG. 7 shows a handle having a head 32*d* which has a textured surface 36 to facilitate grasping of the handle.

The length, orientation of the shaft, size of the head, and other physical features of the handle are offered in various combinations to optimize the usability of the hearing device according to the shape of the ear and dexterity of the individual. An optimal handle can be empirically determined for each individual during the fitting process. Should the user require an alternative handle after the initial fitting process, the existing handle can be readily removed by opening the battery compartment and sliding the handle sideways with moderate pressure. An alternative handle can then be readily inserted as described above.

Figure 8:
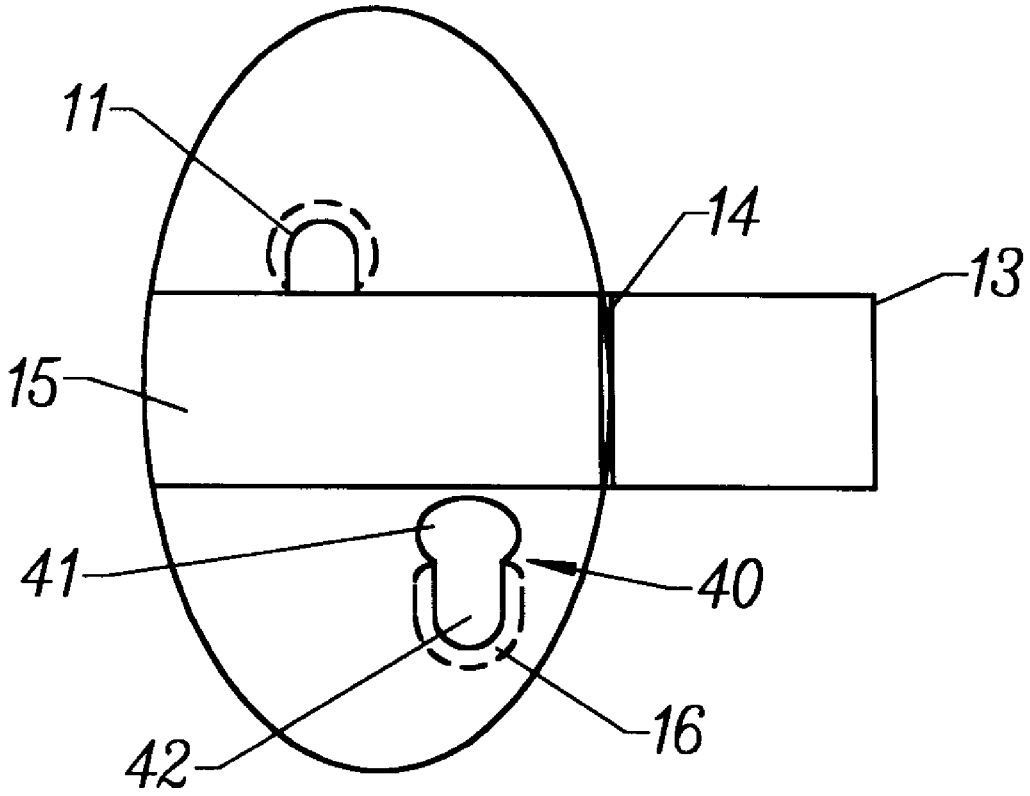
FIG. 8 shows alternative positions for the locking receptacle on the lateral end of a hearing device according to the invention.

The invention provides a handle that is securely attached to the hearing device to withstand substantial push and pull forces, representing device insertion and removal, respectively. In the preferred embodiment of the invention, access to the handle locking receptacle 11 is provided via the battery cavity 15. However, direct access to the locking receptacle 11, as shown in FIG. 8, is also possible as an alternative to the locking receptacle 40. The receptacle guide cavity 41 allows the handle locking end 33 to be initially inserted prior to securing in the permanent locking cavity 42. Similarly, the receptacle recess 16 and locking ledge 17 secure the handle locking end 33 when it is fully inserted therein.

Multiple locking receptacles on the lateral end 12 of a hearing device offer additional options to the user to empirically optimize the relationship of the shaft 30 with respect to the hearing device 10 according to individual needs and preferences.

Figure 9:
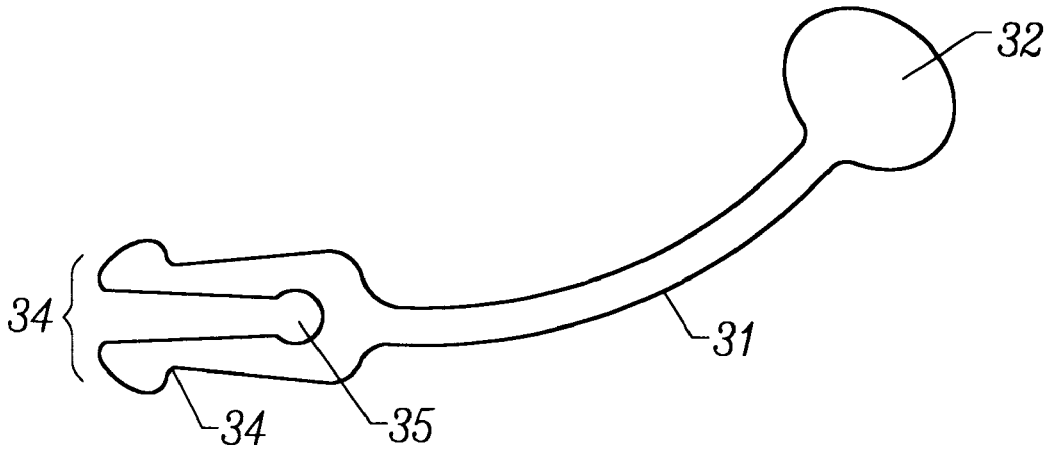
FIG. 9 shows a snap-in handle having a tapered locking end according to the invention.

In another embodiment of the invention, shown in FIG. 9, the handle locking end 33 has tapered legs 34 to provide an axial snap-on locking mechanism. In this embodiment, the legs compress when pushed axially against the locking receptacle opening. The legs then spring back and snap into a locking position within the receptacle cavity. A side opening, such as shown in FIGS. 2 and 8, allows for easy removal of the handle.

Figure 10:
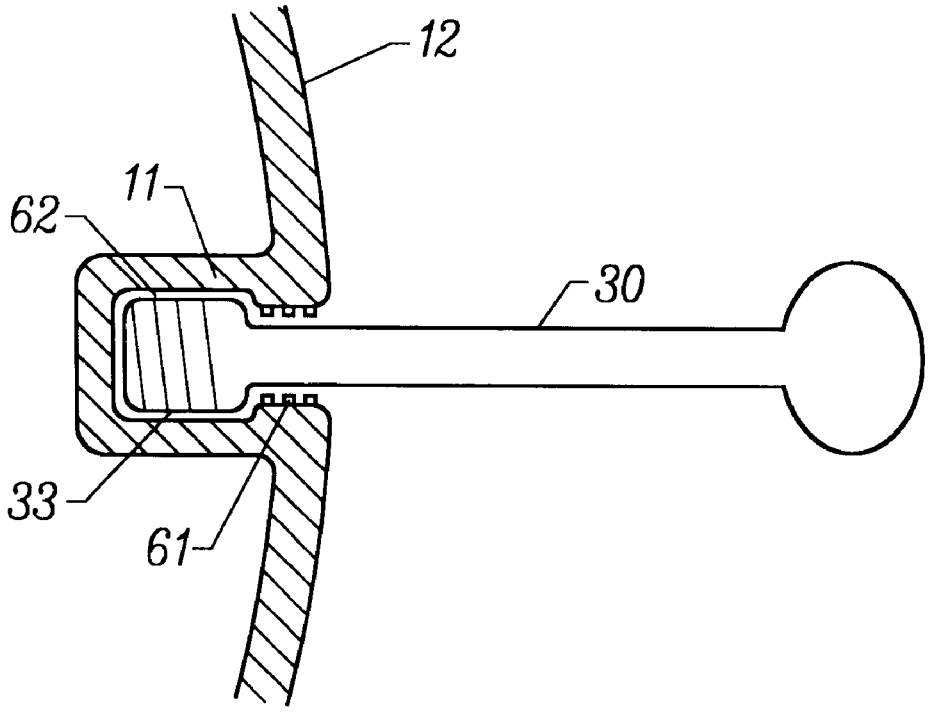
FIG. 10 shows a threaded locking end having a matching locking receptacle according to the invention.

In another embodiment of the invention, shown in FIG. 10, the handle locking end 33 is circular and threaded to be inserted into a receptacle 11 having threaded opening 61 and a locking cavity 62. To insert the handle into the face plate, the handle is rotated clockwise until the threaded locking end 33 penetrates the locking cavity 62 past the threaded opening 61. To remove the handle, a counterclockwise rotation is required. A slight initial pull force may be necessary to engage the threading of the handle and receptacle.

Figure 11:
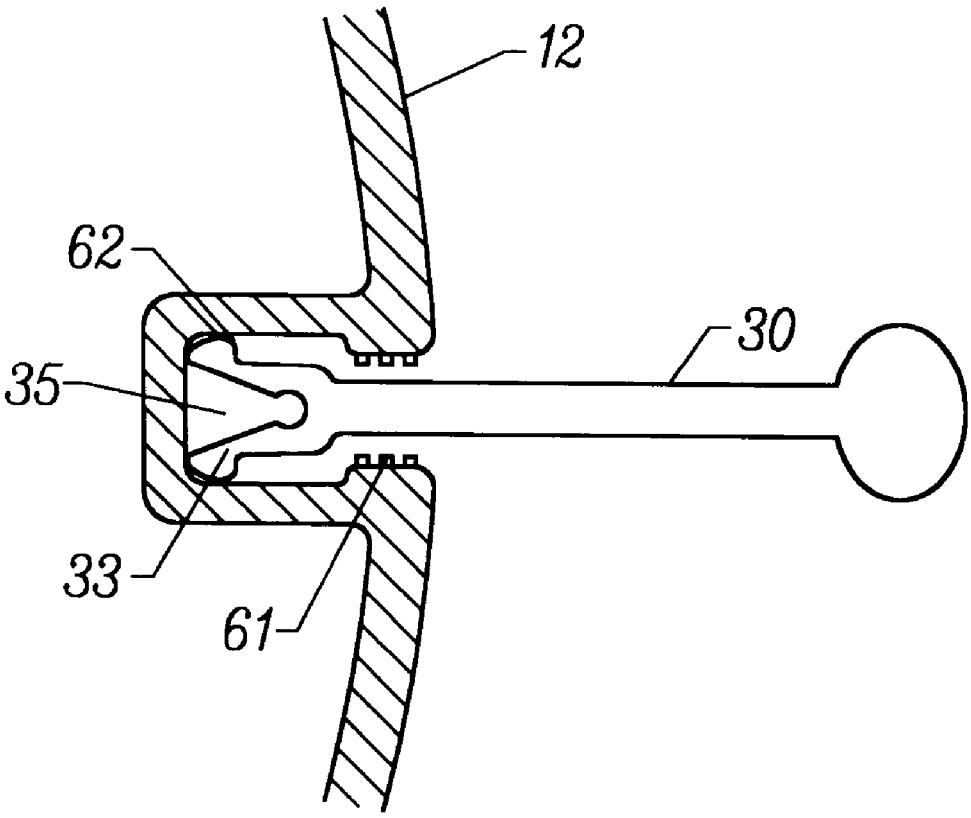
FIG. 11 shows a threaded and compressible locking end having a matching locking receptacle according to the invention.

In another embodiment of the invention, shown in FIG. 11, the locking end 33 is both threaded and compressible at a relieved area 35. Similarly, removal of the handle is initiated by a combination of pull and counterclockwise rotation forces.

Materials suitable for fabricating the invention include, for example, polypropylene, nylon monofilament, cyanoacrylate, and acrylic polymers. The present list of materials, however, does not exclude the use of other materials in the manufacture of the invention.

The hearing device of the invention is not limited to hearing aids for the hearing impaired but is equally applicable to any hearing device containing a transducer for imparting audible signals to the tympanic membrane. The hearing device may be directly connected to an audio source via an electrical cable or via a wireless connection including an infrared (IR), radio frequency (RF), or electromagnetic (EM) interface.

Accordingly, the invention should only be limited by the claims included below.

We claim:

1. A handle for use with a hearing device that is deeply inserted into a users ear canal, the handle comprising:

a shaft having a head and a locking end, said locking end being adapted for ready insertion into, secure retention within, and ready removal from a locking receptacle within a lateral surface of said hearing device, wherein said handle is fabricated from materials that include any of polypropylene, nylon monofilament, cyanoacrylate, and acrylic polymers.

2. The handle of claim 1, wherein said handle is provided in any of a plurality of shapes, lengths, rigidity, and orientation to optimize the usability of said hearing device according to individual requirements of said user.

3. The handle of claim 1, wherein said handle is adapted for use with an articulated hearing device comprising either of a receiver module and an earpiece, each of which is placed deeply into the user's ear canal proximal to the tympanic membrane, and that is articulated with respect to a main module positioned relatively further from the tympanic membrane.

4. The handle of claim 1, said hearing device further comprising:

a cavity formed within and adapted to provide said handle with access to said locking receptacle.

5. The handle of claim 4, wherein said cavity is formed by a hearing device battery compartment.

6. The handle of claim 1, said locking end further comprising:

one or more locking legs which are compressible during insertion.

7. The handle of claim 6, said locking legs further comprising:

a relieved area adapted to facilitate compression of said locking legs.

8. The handle of claim 1, said locking receptacle further comprising:

a receptacle recess; and a locking ledge, wherein said receptacle recess and locking ledge are situated beneath said hearing device lateral surface and are adapted to secure said handle locking end within said locking receptacle when said locking end is fully inserted into said locking receptacle and said locking legs have assumed an uncompressed condition.

9. The handle of claim 1, wherein said handle has a head having a textured surface to facilitate grasping said handle.

10. The handle of claim 1, said hearing device further comprising:

multiple locking receptacles.

11. The handle of claim 1, wherein said handle locking end has tapered legs that are adapted to provide an axial snap-on locking mechanism in which said legs compress when said handle is pushed axially against an opening of said locking receptacle.

12. The handle of claim 1, wherein said locking end is circular and threaded; and wherein said locking receptacle further comprises:

a receptacle having a threaded opening and a locking cavity;

wherein said handle is adapted to be inserted into said locking cavity by rotation thereof in a first direction until said threaded locking end penetrates said locking cavity past said threaded opening; and wherein said handle is adapted to be removed from said locking cavity by rotation thereof in a second, opposite direction.

13. The handle of claim 1, wherein said locking end is both threaded and compressible; and wherein removal of said handle from said locking cavity is initiated by a combination of pull and rotational forces.

14. A hearing device that is deeply inserted into a user's ear canal, comprising:

a handle comprising a shaft having a head and a locking end, said locking end being adapted for ready insertion into, secure retention within, and ready removal from a locking receptacle within a lateral surface of said hearing device, wherein said handle is fabricated from materials that include any of polypropylene, nylon monofilament, cyanoacrylate, and acrylic polymers.

15. The hearing device of claim 14, wherein said hearing device is any of a hearing aid for the hearing impaired or an audio device for communicating audible signals into the ear canal of a user.

16. The hearing device of claim 14, wherein said handle is adapted for use with an articulated hearing device comprising either of a receiver module and an earpiece, each of which is placed deeply into the user's ear canal proximal to the tympanic membrane, and that is articulated with respect to a main module positioned relatively further from the tympanic membrane.

17. The hearing device of claim 14, further comprising:

a cavity formed within and adapted to provide said handle with access to said locking receptacle.

18. The hearing device of claim 17, wherein said cavity is formed by a hearing device battery compartment.

19. The hearing device of claim 14, further comprising:

multiple locking receptacles formed in said hearing device lateral surface to allow said user to empirically optimize the relationship of said handle with respect to said hearing device according to said user's needs and preferences.

* * * * *